US005890943A

United States Patent [19]

Poulsen et al.

[11] Patent Number: 5,890,943

[45] Date of Patent: Apr. 6, 1999

[54] CONSTRUCTIONAL BUILDING SET COMPRISING GEAR BOX CASINGS

[75] Inventors: Ole Vestergaard Poulsen, Vejle; Sten Schmidt, Grindsted, both of Denmark

[73] Assignee: INTERLEGO AG, Baar, Switzerland

[21] Appl. No.: 809,514

[22] PCT Filed: Sep. 28, 1995

[86] PCT No.: PCT/DK95/00390

§ 371 Date: May 5, 1997

§ 102(e) Date: May 5, 1997

[87] PCT Pub. No.: WO96/09866

PCT Pub. Date: Apr. 4, 1996

[30] Foreign Application Priority Data

Sep. 29, 1994 [DK] Denmark ..... 1123/94

[51] Int. Cl.[6] ..... A63H 33/12; A63H 33/08

[52] U.S. Cl. ..... 446/103; 446/128

[58] Field of Search ..... 446/102, 103, 446/104, 128, 127, 86, 85; 434/401, 302

[56] References Cited

U.S. PATENT DOCUMENTS

| | | | |
|---|---|---|---|
| 3,638,352 | 2/1972 | Christiansen | 446/102 X |
| 4,109,398 | 8/1978 | Hida | 434/401 X |
| 4,458,441 | 7/1984 | Bril | 446/103 X |
| 5,071,384 | 12/1991 | Poulsen | 446/103 |
| 5,259,803 | 11/1993 | Lyman | 446/128 X |
| 5,346,420 | 9/1994 | Glickman | 446/85 X |
| 5,411,428 | 5/1995 | Orii et al. | 446/128 X |

FOREIGN PATENT DOCUMENTS

| | | | |
|---|---|---|---|
| 145843 | 3/1983 | Denmark . | |
| 0104716 | 4/1984 | European Pat. Off. | 446/103 |
| 0430850 | 6/1991 | European Pat. Off. | 446/85 |
| 2240609 | 3/1975 | France | 446/103 |
| 330498 | 11/1970 | Sweden . | |
| 1292262 | 10/1972 | United Kingdom . | |
| 1564855 | 4/1980 | United Kingdom . | |

*Primary Examiner*—Robert A. Hafer
*Assistant Examiner*—D Neal Muir
*Attorney, Agent, or Firm*—Kane,Dalsimer,Sullivan,Kurucz, Levy,Eisele and Richard, LLP

[57] ABSTRACT constructional building set comprising gear boxes which are provided with guide grooves and shaft passages. The guide grooves and the shaft passages are constructed such that transmission elements can be inserted into the guide grooves from the outer side of the gear box in such a manner that the transmission elements are positioned in alignment with the shaft passages in the gear boxes. When the gear box additionally comprises means for releasable geometrical retention of the transmission elements in their position in alignment with the shaft passages after insertion of the transmission elements into the gear box, it is ensured that the shafts can be pulled out of the assembled gear structure without the transmission elements dropping out of the gear structure. This simplifies the mounting operation and makes it easier to use the gear structure as an assembled unit that can be used for different applications.

9 Claims, 3 Drawing Sheets

CONSTRUCTIONAL BUILDING SET COMPRISING GEAR BOX CASINGS

BACKGROUND OF THE INVENTION

1. Field of the Invention

The present invention concerns a constructional building set comprising gear box casings which are provided with guide grooves and shaft passages constructed such that transmission elements can be inserted into the guide grooves from the outer side of the gear box casing so that the transmission elements are positioned in alignment with the shaft passages.

In connection with constructional building sets e.g. for the building of toy vehicles, cranes, machinery and the like the gear box casings with inserted transmission elements perform various transmission tasks which can be achieved using known gear wheels, racks, chain drives and similar transmission elements.

2. Description of the Prior Art

Particularly in connection with toy constructional building sets it is important in view of the motor function of the child that these gear box casings with transmission elements are as simple to assemble as possible. Thus, the Danish Patent No. 161 868 discloses a steering mechanism comprising a rack assembly including a rack and a gear wheel which can engage the rack. The gear wheel is mounted in a housing through which also the rack extends, there being provided a groove through which the gear wheel is inserted into the housing, said groove being closed at one end in a manner such that the gear wheel, when inserted into the housing, is positioned in alignment with shaft passages which are provided in the housing so that a shaft can easily be inserted through the shaft passages in the housing as well as the shaft hole on the gear wheel. When the shaft is pulled out of the housing and the gear wheel-again, the gear wheel can thus drop freely out of the housing.

The object of the present invention is to provide a toy constructional building set comprising gear box casings which enable and facilitate assembly of the gear housing, the transmission elements and the associated shafts to a higher degree than the prior art. Another object is to provide a toy constructional building set enabling the shafts to be pulled out from a mounted gear unit without the individual transmission elements dropping out of the gear box casing, thereby enabling easy and quick transfer of a gear unit comprising gear box casing and transmission elements e.g. from one toy structure to another.

SUMMARY OF THE INVENTION

This is achieved, in that the gear box casing in the toy constructional building set stated in the opening paragraph additionally comprises means for releasable geometrical retention of the transmission elements in the position in alignment with the shaft passages after insertion of the transmission elements into the gear box casing.

This geometrical retention may be established in expedient embodiments either by using one or more locking elements adapted to be releasably secured on the gear box casing, such that the guide grooves are blocked from the outer side of the gear box casing, or in that the gear box casing is provided with snap means positioned at the guide grooves in such a manner that the transmission elements are secured by the snap means in the gear box casing in alignment with the shaft passages.

The locking elements may be formed by a cover plate in an expedient embodiment which ensures extremely simple disassembly and assembly of the gear unit.

The snap means may expediently be formed by constrictions in the above-mentioned guide grooves whereby the snap means form an integral part of the guide grooves.

When the gear box casing is provided with coupling knobs, the gear box casing may be incorporated as a unit in a constructional building set comprising building blocks having similar coupling means.

In the latter connection, it is expedient that the gear box casing has an outer configuration with dimensions corresponding to a whole multiple of given modular measures in length, depth and width thereby providing many possibilities of building two or more gear units in the constructional building set together.

BRIEF DESCRIPTION OF THE DRAWINGS

The invention will be described more fully below with reference to the drawing, in which.

DESCRIPTION OF THE PREFERRED EMBODIMENTS

Figure 1:
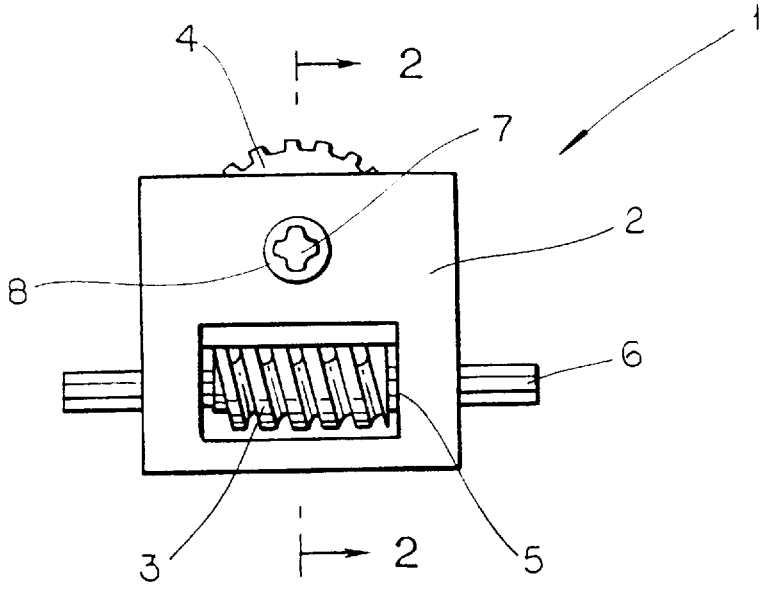
FIG. 1 is a lateral view of an embodiment according to the invention of a mounted gear unit in the form of a worm gear.

FIG. 1 thus shows a gear unit 1 comprising a gear box casing 1 which is provided with a worm 3 and a gear wheel 4 which engages the worm 3. The worm 3 is positioned in an opening 5 in the gear box casing 2, and a shaft 6 extends in a known manner through shaft passages in the gear box casing 2 and the worm 3. The gear wheel 4 is similarly secured in the gear box casing 2 by the shaft 7 which extends through shaft passages 8 in the gear box casing 2 and through the gear wheel 4 in a known manner. The shafts 6 and 7 are here shown as cross-shafts, i.e. they have a cross-shaped cross-section gripping in a known manner the cross-shaped shaft passages in the worm 3 as well as the gear wheel 4, thereby ensuring that the shafts 6, 7 and the transmission elements 3, 4 cannot rotate mutually.

Figure 2:
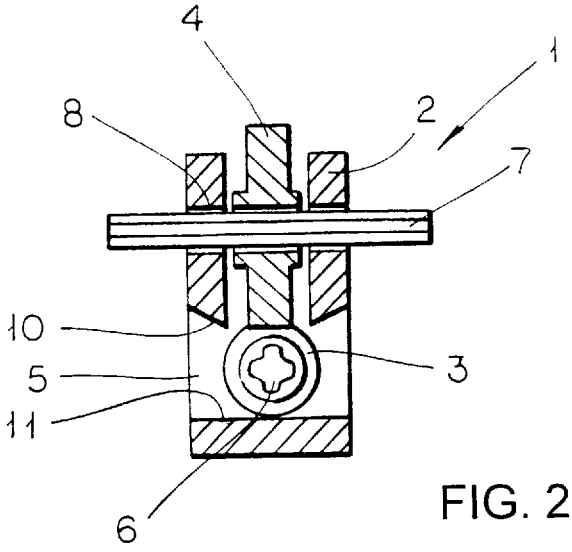
FIG. 2 is a cross-sectional view through the gear unit shown in FIG. 1 along the lines A—A.

FIG. 2 is a sectional view of the worm gear of FIG. 1 along the line A—A. It will be seen how the worm 3 engages the gear wheel 4, which is secured in the casing 2 by means of the shaft 7.

When the gear unit is to be mounted, the worm 3 is inserted through the opening 5 on one or the other side of the gear box casing 2, which is defined by the faces 10 and 11. As shown in the drawing, the opening 5 is formed with a converging cross-section, the face 10 being inclined with respect to the face 11. Since the diameter of the worm 3 is slightly larger than the smallest gap between the faces 10 and 11, it is necessary to exert a certain pressure when inserting the worm 3 into the opening 5. It is hereby ensured that the worm 3 is secured in the gear box casing 2 by snap-locking. If the shaft 6 is pulled out of both the worm 3 and the shaft passages in the gear box casing 2, the worm 3 will remain in position because of this snap effect and will not drop out of the gear box casing 2. This facilitates both mounting of the gear unit 1 as well as possible transfer of the gear unit 1 from one application to another. If the gear unit 1 in a given toy structure serves as a drive unit for a crane, but should desirably be used e.g. in connection with a vehicle or a machine or the like, the shaft 6 can be pulled out of the gear unit without any problems, and the gear unit can be transferred to the new toy application without the worm dropping out.

Figure 3:
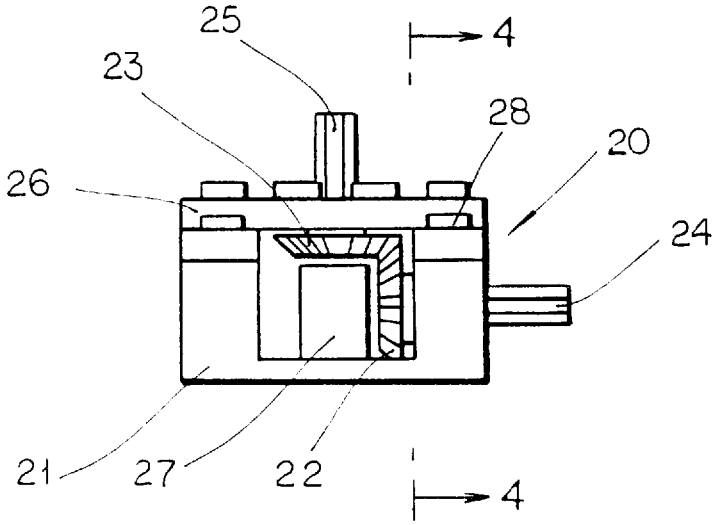
FIG. 3 is a lateral view of another embodiment of the invention in the form of a right angle gear.

FIG. 3 shows another embodiment of the invention, in which the gear unit 20 comprises a gear box casing 21 which is provided with conical gear wheels 22 and 23, said gear unit 20 being configured as a right-angle gear. The conical gear wheels 22 and 23 are connected with the shafts 24 and 25 via shaft passages. A locking part 26, which will be described more fully below, is mounted on the gear box casing 21. The shaft passage for the shaft 24 thus extends through the gear box casing 21, and the shaft passage for the shaft 25 extends through the locking part 26. The conical gear wheels 22 and 23 are secured in an axial direction by the stop element 27, said gear wheels 22 and 23 being thereby fixed in the axial direction with respect to the gear box casing 21 and the locking part 26. The locking part 26 is mounted on the gear box casing 21 in such a manner that it can be removed, said gear housing 21 being provided with coupling studs 28 capable of engaging complementary coupling means (not shown) on the locking element 26.

Figure 4:
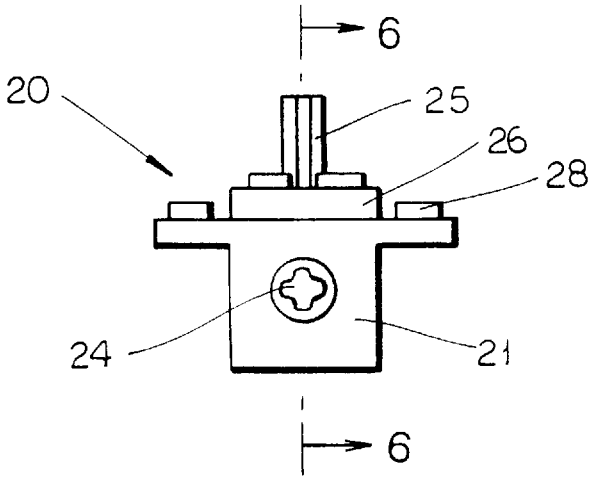
FIG. 4 is an end view of the unit of FIG. 3.

FIG. 4 shows the gear unit 20 of FIG. 3 from the end from which the shaft 24 extends out through the gear box casing 21.

Figure 5:
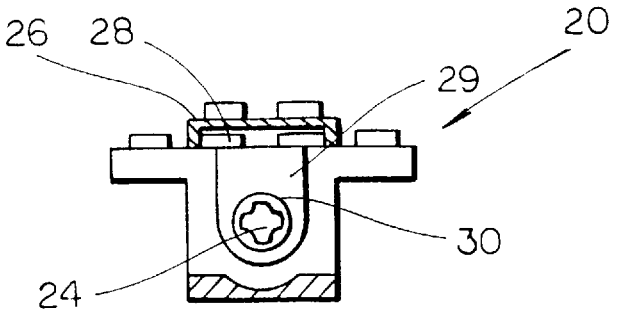
FIG. 5 are sectional views of the gear unit of FIGS. 3 and 4 along the line C—C in FIG. 3.

FIG. 5 shows a section through the gear unit of FIG. 3 along the line C—C, it being shown how the gear box casing 21 is formed with a groove 29 in the form of a recess which extends from the upper face of the gear box casing 21 down past the shaft passage 30, through which the shaft 24 extends. As shown in FIG. 5, the locking element 26 blocks the groove 29 so that the gear wheel 22, as shown in FIG. 3, cannot drop out in the direction in which the groove 29 extends. However, since the locking element 26 can be separated from the gear box casing 21, the groove 29 can subsequently be opened.

Figure 6:
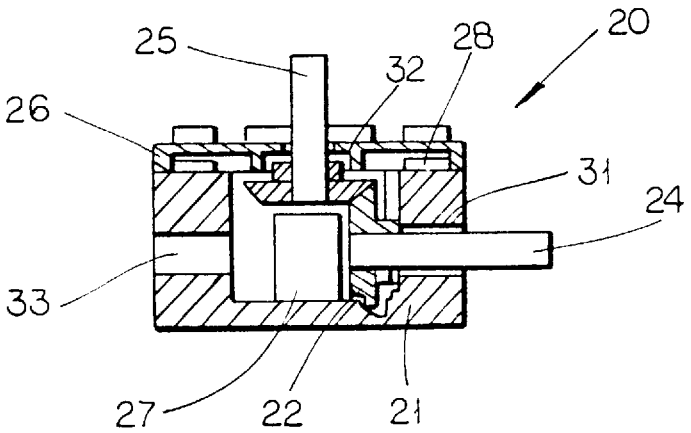
FIG. 6 is a sectional view of the gear unit of FIGS. 3 and 4 along B—B.

FIG. 6 shows another section along the lines B—B in FIG. 4 through the gear unit of FIGS. 3 and 4, with the shaft passages 31 and 32 extending in the gear box casing 21 and the locking element 26, respectively. It is additionally shown how the gear box casing 21 may be provided with an additional shaft passage 33, thereby enabling gear units having different functions to be built. The figure moreover shows that the gear wheel 22 is provided with an annular collar 34 which extends into the groove 29 on the gear box casing 21. It is ensured in this manner that the gear wheel 22 cannot drop out of the gear box casing 21, since the locking element 26 blocks upwardly, and since the engagement between the collars 34 on the gear wheel 22 and the groove 29 ensures that the gear wheel 22 cannot drop laterally out of the gear box casing 21. It will hereby be possible to pull out the shaft 24 without the gear wheel dropping out.

It is clear that it is possible to work the invention in connection with gear units of different structures which provide the same advantage, viz. that it is possible to pull out the shafts from the gear unit without the transmission elements in the form of e.g. gear wheels, chain wheels, friction wheels or the like dropping out. This permits the shafts, which are used in the gear unit, to have different lengths or structures so that the gear unit can easily be transferred from one application to another.

The gear units of the invention therefore provide great advantages in connection with toys, since it is made considerably easier to mount the gear units and to transfer the gear units to various applications when playing. The motor function required of the playing child therefore does not necessarily have to be just as fine as is the case in connection with known structures.

We claim:

1. A constructional building set comprising a number of transmission elements and a gear box casing (2) which are provided with guide grooves (5, 29) and shaft passages (8, 31, 33) constructed such that the transmission elements (3, 4, 22, 23) can be inserted into the guide grooves (10, 11, 29) from an outer side of the gear box casing (2) so that the transmission elements (3, 4, 22, 23) are positioned in alignment with the shaft passages, characterized in that the gear box casing additionally comprises means (10, 26) which form part of the casing itself for releasable geometrical retention of the transmission elements in the position in alignment with the shaft passages (8, 31, 33) after insertion of the transmission elements into the gear box casing where after removal of a shaft which removably mounts said transmission element, said transmission element may be removed easily from said gear box casing through said guide groove.

2. A constructional building set according to claim 1, characterized in that the means for releasable retention of the transmission elements comprise one or more locking elements (26) adapted to be releasably secured on the gear box casing so that access to the guide grooves is blocked from the outer side of the gear box casing.

3. A constructional building set according to claim 2, characterized in that the gear box casing is provided with coupling knobs (28) at an outlet of the guide grooves (29) on the outer side of the gear box casing, and that the locking element is formed by a cover plate (26) which has complementary coupling means and is constructed so as to block the outlet of the guide grooves (29) on the outer side of the gear box casing after mounting on the coupling knobs (28).

4. A constructional building set according to claim 1, characterized in that the means for releasable retention of the transmission elements comprise snap means (10, 11) positioned at the guide grooves (5) in such a manner that the transmission elements are secured by the snap means (10, 11) in the gear box casing in alignment with the shaft passages.

5. A constructional building set according to claim 4, characterized in that the snap means are formed by one or more constrictions in the cross-section of the guide grooves, said constrictions being provided in front of the shaft passage to which the guide groove leads, seen in relation to the direction in which the transmission element is inserted into the guide groove.

6. A constructional building set according to claim 1, 2, 3, or 5, characterized in that the gear box casing, on at least one side, has coupling means positioned in a square pattern and adapted to be coupled with other elements in the building set which are provided with complementary coupling means.

7. A constructional building set according to claim 6, characterized in that the gear box casing has a substantially casing-shaped outer configuration with dimensions corresponding to a whole multiple of given modular measures in length, depth and width, and that the shaft passages are so located on the sides of the gear box casing as to enable at least two gear box casings having transmission elements to be built together by means of the coupling means, so that the shaft passages on one gear box casing are in alignment with shaft passages on the other gear box casing.

8. A constructional building set according to claim 6, characterized in that the shafts (6, 7, 24, 25) are formed with one or more splines which extend in the longitudinal direction of the shaft, and that the shaft hole in the transmission elements have complementary splines to engage the longitudinal splines on the shafts.

9. A constructional building set according to claim 6, characterized in that the shafts (6, 7, 24, 25) and the shaft holes of the transmission elements have a mutual dimension so as to provide a frictional coupling between the shafts and the transmission elements upon assembly of these.

* * * * *

UNITED STATES PATENT AND TRADEMARK OFFICE

CERTIFICATE OF CORRECTION

PATENT NO. : 5,890,943

DATED : April 6, 1999

INVENTOR(S) : Ole Vestergaard Poulsen, et. al.

It is certified that error appears in the above-identified patent and that said Letters Patent is hereby corrected as shown below:

Title page, item [54] and col. 1, line 2, should read as following:

CONSTRUCTIONAL BUILDING SET
COMPRISING GEAR BOXES

Signed and Sealed this

Twenty-first Day of September, 1999

*Attest:*

Q. TODD DICKINSON

*Attesting Officer*

*Acting Commissioner of Patents and Trademarks*